US010681988B2

(12) United States Patent
Andrews

(10) Patent No.: US 10,681,988 B2
(45) Date of Patent: Jun. 16, 2020

(54) HOLDER FOR A CHAIR

(71) Applicant: Debbie Andrews, St. Louis, MO (US)

(72) Inventor: Debbie Andrews, St. Louis, MO (US)

( * ) Notice: Subject to any disclaimer, the term of this patent is extended or adjusted under 35 U.S.C. 154(b) by 0 days.

(21) Appl. No.: 16/192,354

(22) Filed: Nov. 15, 2018

(65) Prior Publication Data

US 2019/0142171 A1 May 16, 2019

Related U.S. Application Data

(60) Provisional application No. 62/587,445, filed on Nov. 16, 2017.

(51) Int. Cl.

| | |
|---|---|
| ***A47C 7/62*** | (2006.01) |
| ***A45F 3/14*** | (2006.01) |
| ***A45F 3/02*** | (2006.01) |
| ***A45F 4/02*** | (2006.01) |

(52) U.S. Cl.

CPC ..... *A47C 7/626* (2018.08); *A45F 3/02* (2013.01); *A45F 3/14* (2013.01); *A45F 4/02* (2013.01); *A45F 2003/142* (2013.01); *A45F 2004/026* (2013.01)

(58) Field of Classification Search

CPC ... A47C 7/626; A45F 3/02; A45F 3/14; A45F 4/02; A45F 2003/142; A45F 2004/026; B60R 7/043

USPC ..... 297/188.12, 188.08, 188.01

See application file for complete search history.

(56) References Cited

U.S. PATENT DOCUMENTS

| | | | | | |
|---|---|---|---|---|---|
| 5,573,288 | A * | 11/1996 | Raffensperger | A47C 1/16 | 297/188.1 |
| 6,053,570 | A * | 4/2000 | Stern | A47C 7/62 | 211/86.01 |
| 6,079,599 | A * | 6/2000 | Nordstrom | A45C 11/20 | 224/153 |
| 8,123,090 | B2 * | 2/2012 | Missick | A45F 4/02 | 224/153 |
| 8,403,413 | B2 * | 3/2013 | Scott | A47D 1/103 | 297/250.1 |
| 2005/0062319 | A1 * | 3/2005 | Hough | B63C 9/22 | 297/188.08 |
| 2006/0006705 | A1 * | 1/2006 | Charbonneau | A47C 7/62 | 297/188.08 |
| 2007/0084891 | A1 * | 4/2007 | Gillespie | A45F 4/02 | 224/155 |
| 2012/0211536 | A1 * | 8/2012 | Lowry | A45F 4/02 | 224/627 |
| 2015/0038030 | A1 * | 2/2015 | White | B63C 9/23 | 441/88 |
| 2015/0096908 | A1 * | 4/2015 | Nadler | A45F 4/02 | 206/216 |
| 2018/0118124 | A1 * | 5/2018 | Leverett | F41A 23/18 | |

* cited by examiner

*Primary Examiner* — Mark R Wendell
(74) *Attorney, Agent, or Firm* — Brett A. Schenck

(57) ABSTRACT

A holder for a chair. The chair includes a seat portion and a back portion. The holder includes a bag. The bag includes a bag opening. At least a first strap is attached to the bag. The first strap extends across the bag. The first strap and the bag define a first opening that is configured to securely receive one of a seat portion and a back portion or both.

20 Claims, 13 Drawing Sheets

HOLDER FOR A CHAIR

CROSS-REFERENCE TO RELATED APPLICATIONS

This application claims benefit under 35 U.S.C. § 119(e) of Provisional Application No. 62/587,445 filed Nov. 16, 2017, the disclosure of which is incorporated by reference in its entirety.

FIELD

This application relates to a holder for a chair

BACKGROUND

When attending a sporting event, a movie theater, concert hall, auditorium or other place that has rows of side by side chairs, there is generally no place to put personal items or giveaways other than on the floor under the chair or on your lap due to the chairs being in close proximity to each other. When the items or giveaways are on the floor, they may be spilled on, stepped, smashed, kicked, accumulate dirt from the floor, interfere with people walking through the aisles between adjacent rows of seats, or otherwise interfere or get damaged. When the items or giveaways are held on a person lap, the extra weight or size is uncomfortable to the person. For other places with chairs, it is desirable to be able to easily transport and store items.

SUMMARY

In one aspect of the present invention, a holder for a chair is provided. The chair includes a seat portion and a back portion. The holder includes a bag. The bag includes a bag opening. At least a first strap is attached to the bag. The first strap extends across the bag. The first strap and the bag define a first opening that is configured to securely receive one of a seat portion and a back portion or both. The holder includes a shoulder strap. The shoulder strap includes first and second axial ends attached near the bag opening. The shoulder strap is configured to enable a user to carry the bag on their shoulder.

In another aspect of the present invention, a holder for a chair is provided. The holder includes a bag. The bag includes opposite first and second portions that define a bag opening. The holder includes at least a first strap. The first strap is attached to the first portion of the bag. The first strap extends across the bag. The first strap and the bag define a first opening that is configured to securely receive a seat portion. The holder includes at least a second strap. The second strap is attached to the first strap. The second strap is attached to the first portion of the bag at a location near the bag opening. The second strap is configured to extend over the seat portion to support the bag to the seat portion.

In another aspect of the present invention, an apparatus is provided. The apparatus includes a bag and at least a first strap. The apparatus further includes a chair. The chair includes a back portion and a seat portion. The bag includes opposite first and second portions that define a bag opening. The first strap is attached to the first portion of the bag. The first strap extends across the bag. The first strap and the bag define a first opening that securely receives a seat portion such that the first portion is position below seat portion and the bag opening faces away from the back portion.

Other aspects of the disclosed holder for a chair will become apparent from the following detailed description, the accompanying drawings and the appended claims.

DETAILED DESCRIPTION

It will be readily understood that the components of the embodiments as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

Figure 1:
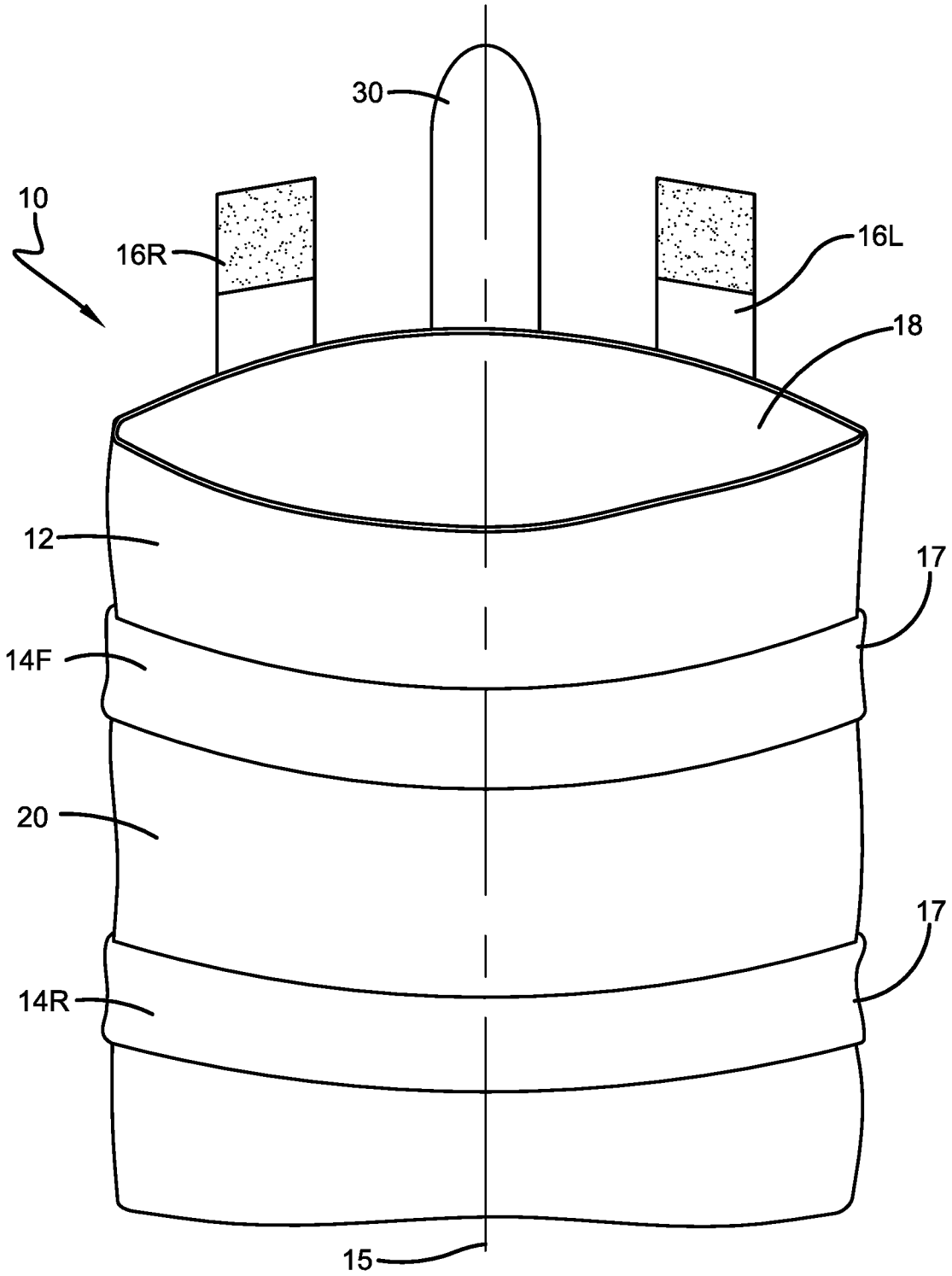
FIG. 1 is a top view of the holder for a chair according to an embodiment of the present invention with the right and left straps detached from the front strap and bag for illustrative purposes.
Figure 2:
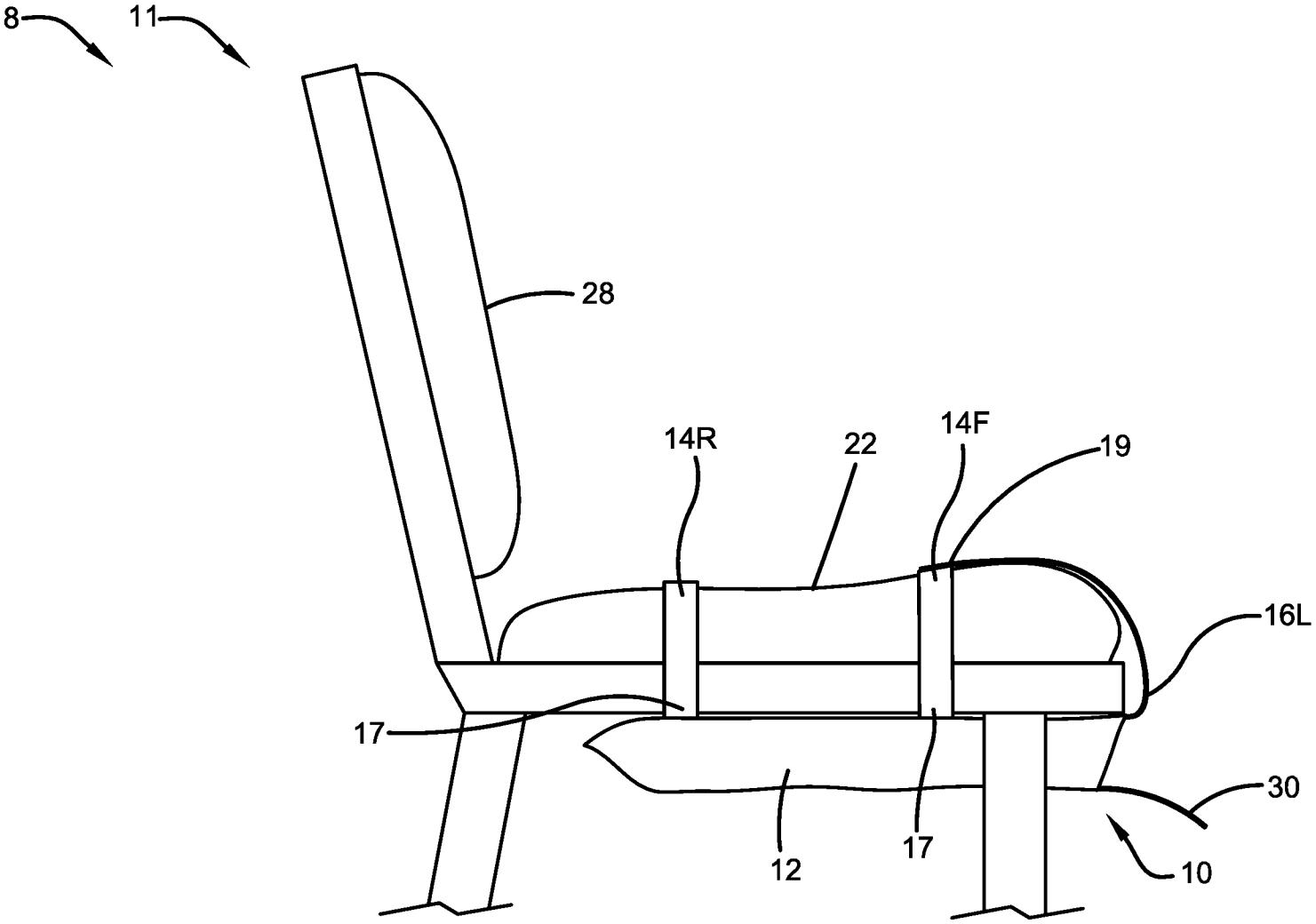
FIG. 2 is a left side view of the holder for a chair of FIG. 1 removably attached to the seat portion.
Figure 3:
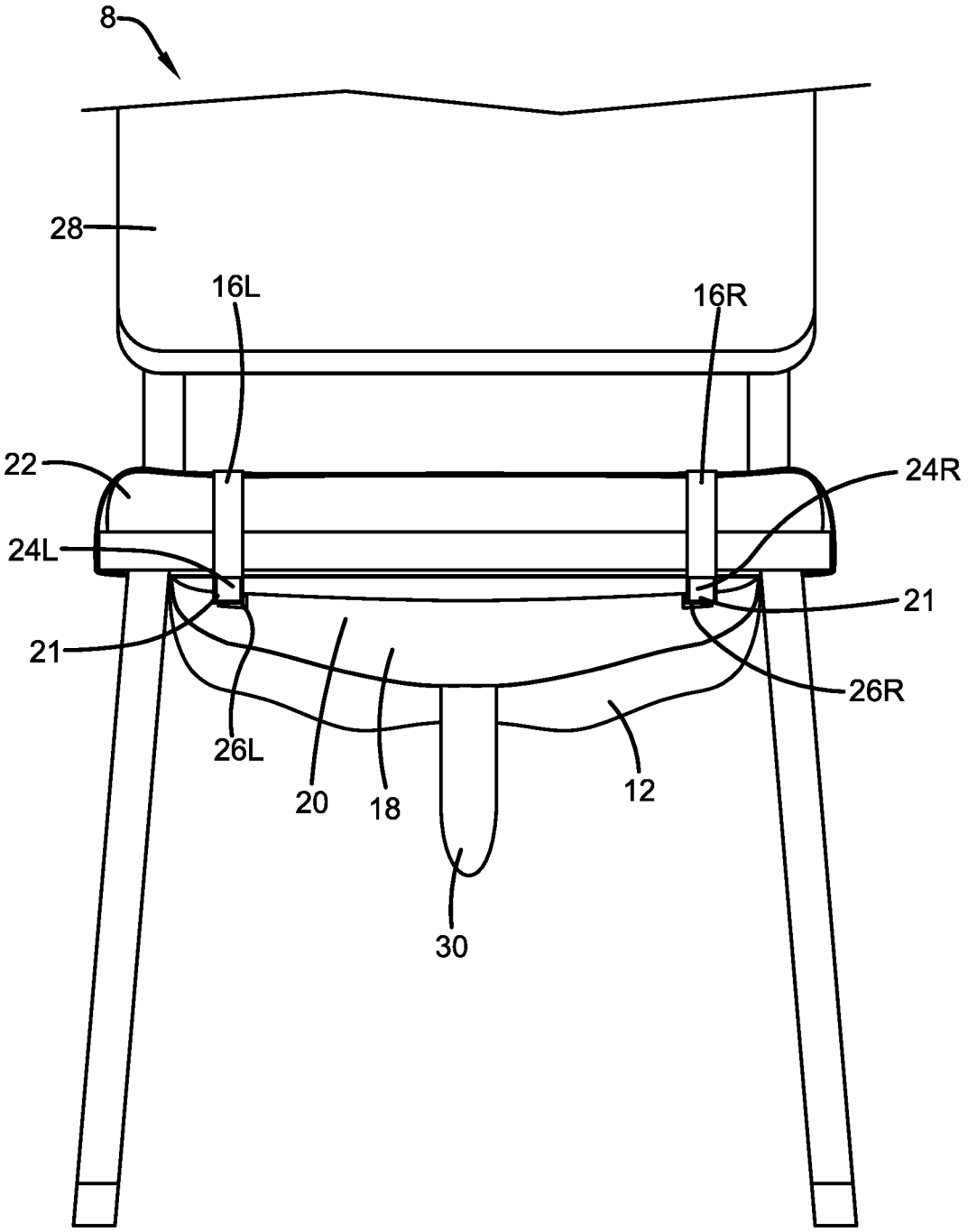
FIG. 3 is a front view of the holder for a chair of FIG. 1 removably attached to the seat portion.

Throughout the present description for the embodiment shown in FIGS. 1-6, the terms "upper", "lower", "top", "bottom", "left", "right", "front", "forward", "rear", and "rearward" shall define directions or orientations with respect to the holder as illustrated in FIG. 3. For the embodiments shown in FIGS. 7-13, the terms "upper", "lower", "top", "bottom", "left", "right", "front", "forward", "rear", and "rearward" shall define directions or orientations with respect to the holder as illustrated in FIG. 7. It will be understood that the spatially relative terms "upper", "lower", "top", "bottom", "left", "right", "front", "forward", "rear", and "rearward" are intended to encompass different orientations of the holder in use or operation in addition to the orientation depicted in the figures. For example, if the holder in the figures is turned over, elements described as "upper" elements or features would then be "lower" elements or features.

Throughout the present description, the terms "longitudinal" and "lateral" shall define directions with respect to the holder. The term "longitudinal" shall refer to a direction extending from the opening 18 of the bag 12 of the holder 10 to the closed end of the bag opposite the bag opening 18. In the example of FIG. 1, the longitudinal direction is illustrated by longitudinal axis 15 which extends from the bag opening 18 to the closed end of the bag opposite the bag opening 18. The term "lateral" shall refer to a direction extending transversely across the side of the bag (e.g., from left to right or from right to left as shown in FIG. 1).

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

An apparatus 8 is illustrated in FIGS. 2-5. The apparatus 8 comprises a holder 10 and a chair 11. Referring to FIGS. 1 and 2, the holder 10 for a chair 11 comprises a bag 12. The bag 12 may be made of a flexible fabric material such as nylon. Other suitable materials that the bag 12 may be made of include, for example, plastic, paper and cotton. The bag material may be made of an elastic material to enable the bag 12 to stretch and expand its volume to allow for large items 23 (FIG. 4) to be placed in the bag 12. The bag material may be waterproof. The bag 12 has a front opening 18 for receiving items. The holder 10 includes a front strap 14F and a rear strap 14R that extend laterally from the left to right side of the bag 12. The front and rear straps 14F, 14R are parallel to each other and extend at least across the top wall or panel 20 of the bag 12. Alternatively, the straps 14F, 14R may extend beyond the top wall 20 or completely around the bag 12.

Figure 5:
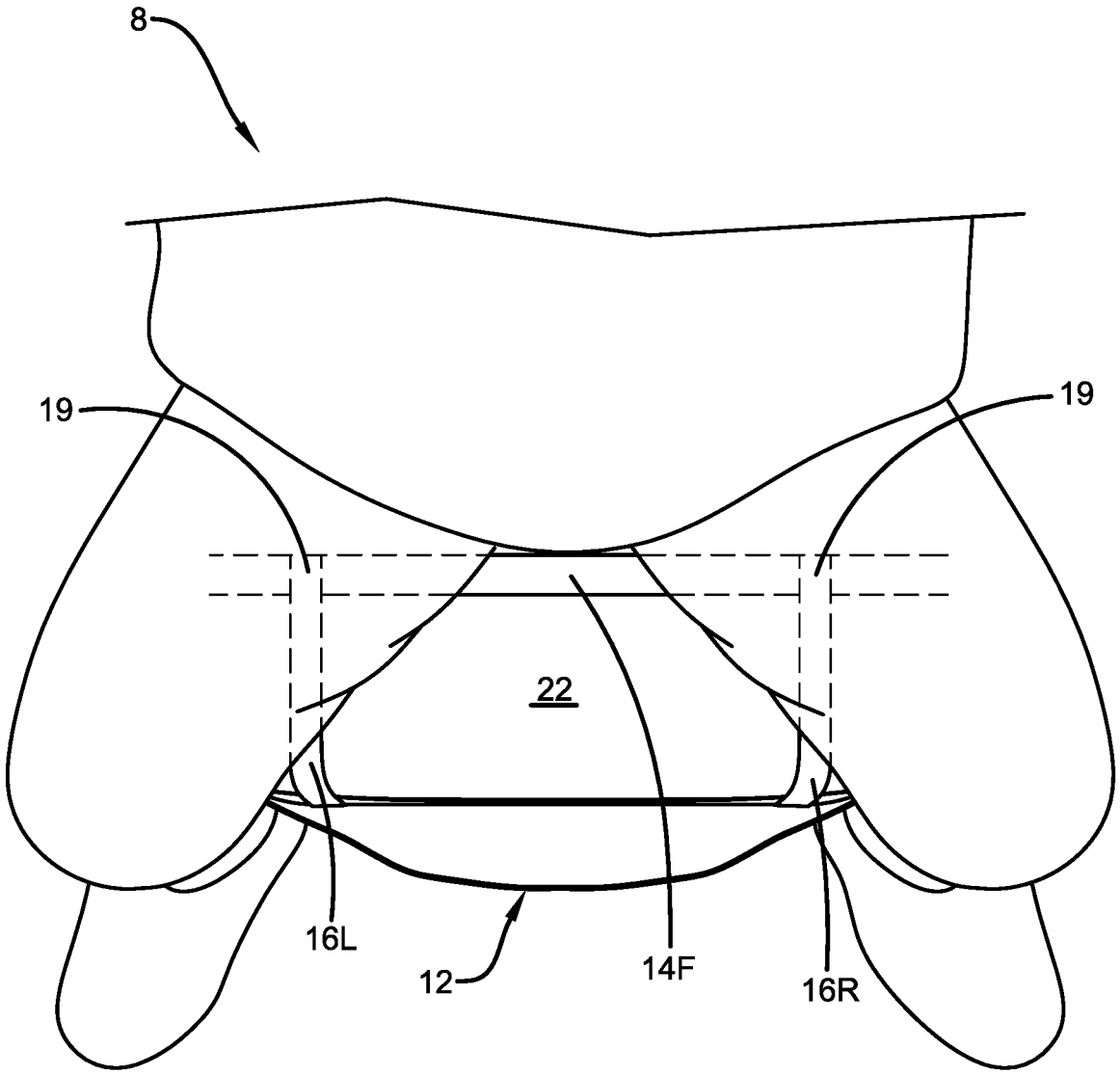
FIG. 5 is a front and top view of a portion of the holder for a chair of FIG. 1 removably attached to the seat portion.

The axial ends 17 of each of the straps 14F, 14R are stitched, sewn or otherwise attached to the bag 12 so that each of the front and rear straps 14F, 14R and the bag 12 define an opening or loop spanning between the axial ends 17 of the straps 14F, 14R for securely receiving the seat portion 22 of the chair 11. The front and rear straps 14F, 14R may be made of a flexible, strong, durable and elastic material. The holder 10 also includes left and right straps 16L, 16R made of a flexible, strong and durable fabric material. As illustrated in FIGS. 2 and 5, the rear axial end 19 of the left strap 16L is sewn, stitched, detachably attached by Velcro® or otherwise attached to the front strap 14F. Likewise, the rear axial end 19 of the right strap 16R is sewn, stitched, detachably attached by Velcro® or otherwise attached to the front strap 14F. The straps may also be configured to have more elasticity in order to stretch more and enable the bag to expand its volume to allow for large items. The front and rear straps 14F, 14R may each be longer to define with the bag a larger size hole that receives the seat portion 22 to allow extra space between the bag 12 and the underside of the seat portion 22 to allow for large items to be placed in the bag 12.

As illustrated in FIG. 3, when the holder is secured to a seat portion 22 of the chair, the right and left straps 16R, 16L extend over the front of the seat portion 22 and the front axial ends 21 of the straps 16R, 16L are each removably attached to the underside of the top wall 20 of the bag 12 by a hook and pile fastener such as Velcro®. In particular, a first lineal fabric strip 24L of loops is sewn or otherwise attached to the underside of the left strap at or near the front axial end 21 of the left strap 16L, and a second lineal fabric strip of loops 24R is sewn or otherwise attached to the underside of the right strap 16R at or near the front axial end 21 of the right strap 16R. A left lineal fabric strip 26L of hooks is sewn or otherwise attached to the underside of the top wall 20 of the bag 12, and a right lineal fabric strip 26R of hooks is attached to the underside of the top wall of the bag 12. When the front axial ends 21 of the straps are attached to the underside of the top wall 20 of the bag 12, the first lineal fabric strip 24L of loops catch the left lineal fabric strip 26L of hooks and the second lineal fabric strip 24R of loops catch the right lineal fabric strip 26R of hooks. This temporarily binds the right and left straps 16R, 16L to the underside of the top wall 20 of the bag to prevent the bag 12 from slipping down when the seat portion 22 of the chair 11 is up in the stowed position. Alternatively, the first and second lineal fabric strips may be comprised of hooks and the left and right lineal fabric strips may be comprised of loops.

Figure 4:
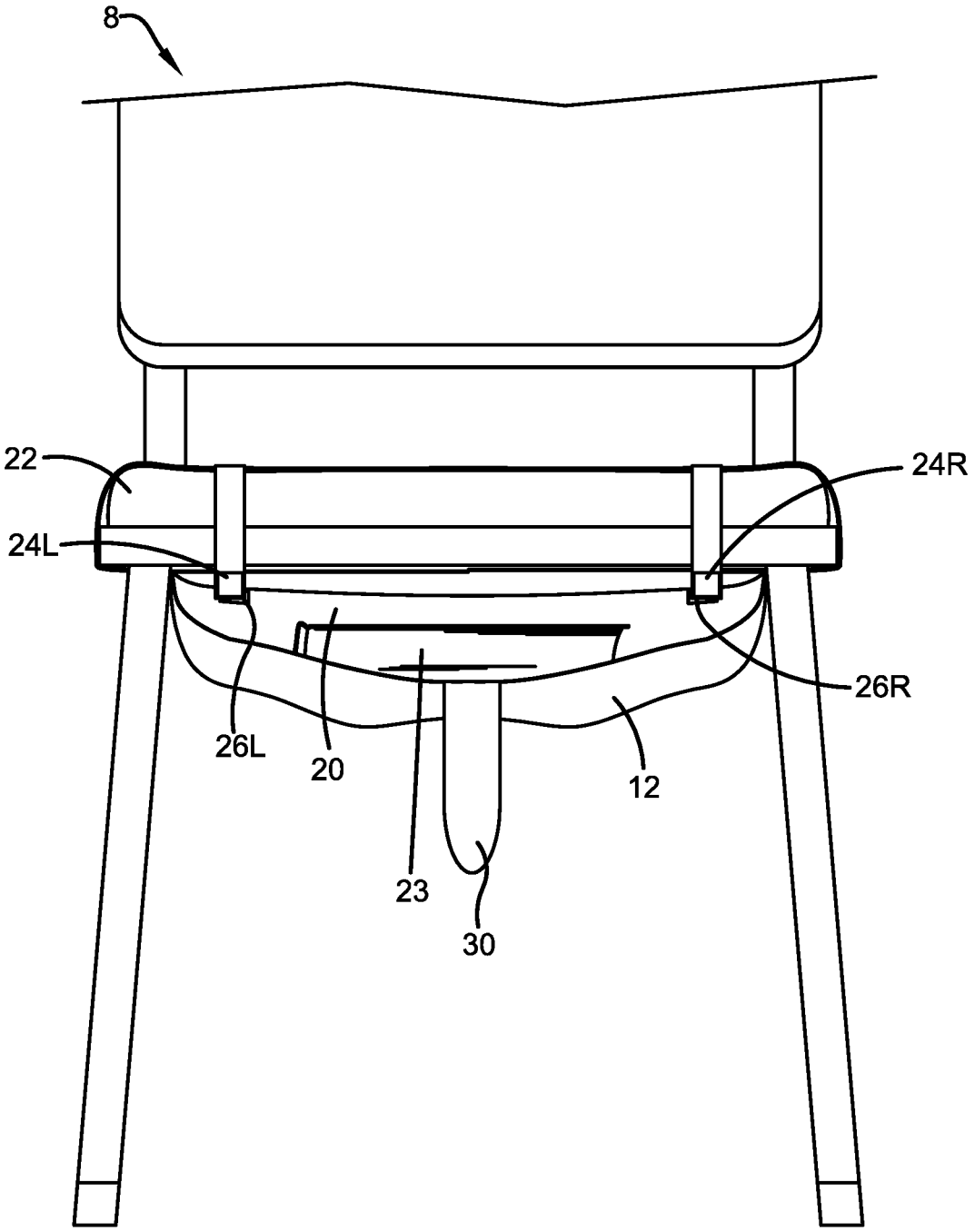
FIG. 4 is a front view of a portion of the holder for a chair of FIG. 1 removably attached to the seat portion and with an object placed inside the holder.

As illustrated in FIGS. 2 and 3, the bag may be removably secured to the chair 11. The chair 11 may have a back portion 28 and the bottom seat portion 22. The seat portion 22 may comprise a cushion. The seat portion 22 may pivot at or near the junction with the back portion to be foldable between the upper stowed position and a lower operative position for sitting. A spring may be operatively connected to the seat portion 22 to urge the seat portion 22 up in the stow position. To secure the bag 12 to chair 11, the elastic front and rear straps 14F, 14R stretched or expanded outwardly if necessary such that the openings or loops are of a sufficient size to receive the seat portion. The straps 14F, 14R may contract to tightly secure the bag 12 to the chair 11. The bag 12 may be secured to the seat portion 22 in the stowed position, operative position or any position of the seat portion there between. Then, leading with the rear strap 14R, the rear and front straps 14F, 14R are slid over the seat portion 22 and the bag 12 is slid under the seat portion 22. To prevent the bag 12 from slipping down when the seat portion 22 is up in the stowed position, the right and left straps 16R, 16L are pulled over the front of the seat portion 22, and the first and second lineal fabric strips 24L, 24R of the left and rear straps 16L, 16R are pressed onto their respective left and right lineal fabric strips 26L, 26R on the underside of the top wall 20 of the bag 12. An item 23 may then be placed in the bag 12 as seen in FIG. 4.

The straps may also be configured to adjust their lengths. For example, the straps may be routed through a cam buckle type arrangement to adjust their length. There may be other ways to removably attach the front axial ends 21 of the right and left straps 16R, 16L to the top wall 20 of bag 12 near the front bag opening 18. For example, the front axial ends 21 of the right and left straps 16R, 16L may be removably attached to the top wall 20 of the bag 12 by a buckle and clasp arrangement or by extending them through an opening or respective openings in the top wall 20 and tying them together. Also, the bag may be removably secured to the back portion 28 of the chair 11. Optionally, to close the bag opening 18 and further secure the item 23 in the bag 12, another strap located between the left and right straps 16L, 16R may be attached to the front strap 14F and extend over the bag opening 18 and be removably attached to the bottom of the bag 12.

Figure 6:
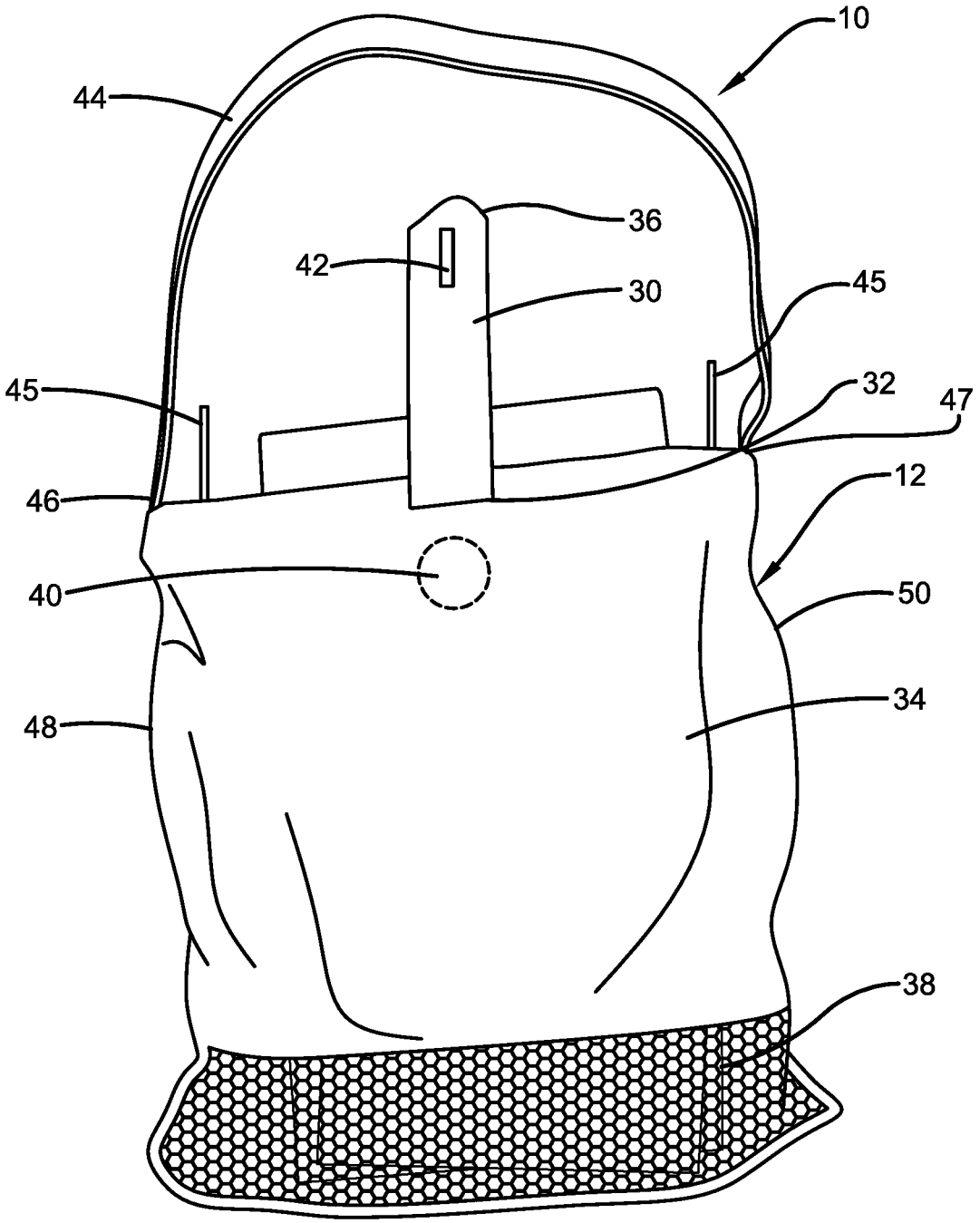
FIG. 6 is a bottom view of the holder for a chair of FIG. 1.
Figure 7:
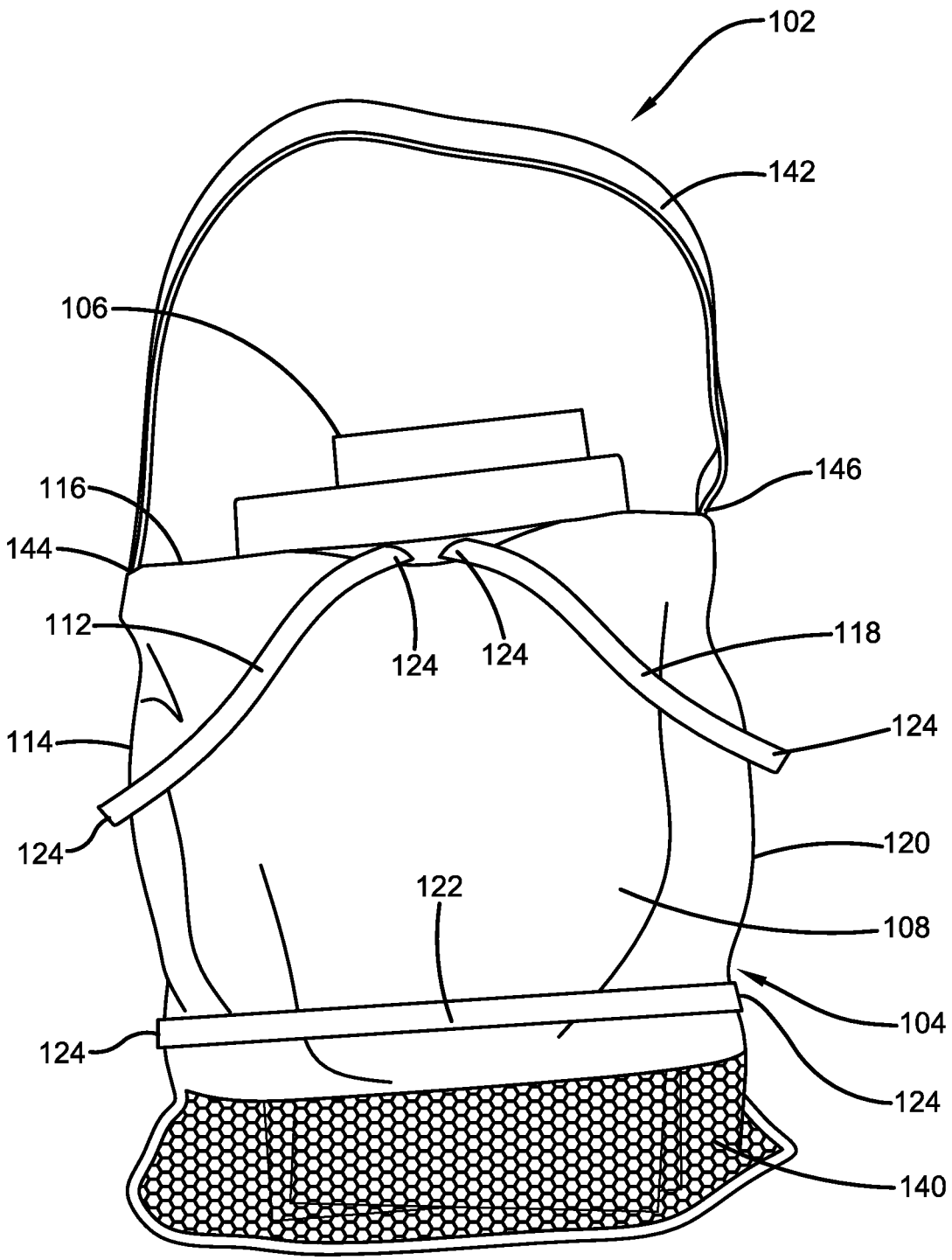
FIG. 7 is a side view of a holder of a chair as viewed in the direction facing the first panel according to another embodiment of the present invention.

As shown in FIGS. 1-6, the bag 12 may include a looping strap 30 that can extend over and across the bag opening 18 in an operative position to at least partially close the bag opening 18. Referring to FIG. 6, the looping strap 30 has a first axial end 32 that may be attached to the bottom wall or panel 34 of the bag 12 and a second axial end 36 that is removably attached to the top wall or panel 20 of the bag (opposite the bottom panel 34) at a location such that the looping strap 30 closes the bag opening 18. In one embodiment, the second axial end 36 may be removably attached to the top panel 20 of the bag 12 by a hook and pile fastener such as Velcro®. In another embodiment, the second axial end 36 may be removably attached to the top panel 20 of the bag 12 by a button 40 as illustrated in FIG. 6. Specifically, the button 40 may be sewn on the top panel 20 and inserted through a slit 42 formed in the strap or vice versa. In another embodiment, the second axial end 36 may be removably attached to the top panel 20 of the bag 12 by a snap arrangement. Alternatively, there may be other ways to close the bag opening 18 of the bag 12. For example, the bag opening 18 may be open and closed by a zipper that extends across the bag opening 18. In another exemplary embodiment (as illustrated in FIG. 6), the closing arrangement may include drawstrings 45 provided at the edge of the bag opening 18. Alternatively, the bag may be closed by two straps in which a first axial end of a first strap is attached to the top panel of the bag and a first axial end of a second strap is attached to the bottom panel of the bag. The two sides are then tied together. Alternatively, the looping strap 30 may not have any fastening arrangement. The looping strap 30 may also be looped around either the front strap 14F or the rear strap 14R and removably fastened on itself in a stowed or storage position for storage if not in use.

As shown in FIG. 6, the bag may include a mesh panel 38 for viewing contents in the bag 12. The mesh panel 38 may be located adjacent the closed end of the bag opposite the bag opening 18. Optionally, the bag 12 may include a shoulder strap 44 (FIG. 6) that is attached to the bag 12 at or near the edge of the opening 18. A first axial end 46 of the shoulder strap 44 may be attached at approximately the junction of the top panel 20 and the first longitudinal end 48 of the bottom panel 34, and a second axial end 47 of the shoulder strap 44 may be attached at approximately the junction of the top panel 20 and the second longitudinal end 50 of the bottom panel 34. In operation, a user's arms extends through the loop defined by the shoulder strap 44 and bag 12 and the shoulder strap 44 rests upon the shoulder of the user.

In this embodiment, the holder 10 for a chair 11 enables the items to stay in a protected bag 12 close to the seat and away from the floor. To remove the holder 10 from the chair 11 after use, the right and left straps 16R, 16L are pulled off and detached from the right and left fabric strips, the front and rear straps 14F, 14R are stretched outward to expand the openings and the bag 12 is pulled forwardly and slipped off of the seat portion 22. Alternatively, the holder may be removed from the seat portion 22 without detaching the right and left straps 16R, 16L from the right and left fabric strips. The holder 10 also includes a shoulder strap 44 so that it can be carried on the shoulder of the user.

This holder 10 for a chair 11 enables the items to stay in a protected bag 12 close to the seat and away from the floor. To remove the holder 10 from the chair 11 after use, the right and left straps 16R, 16L are pulled off and detached from the right and left fabric strips 26R, 26L, the front and rear straps 14F, 14R are stretched outward to expand the openings and the bag 12 is pulled forwardly and slipped off of the seat portion. Alternatively, the holder may be removed from the seat portion 22 without detaching the right and left straps 16R, 16L from the right and left fabric strips 26R, 26L.

Thus, this exemplary embodiment of the present invention provides a solution to the above-mentioned problem by removably securing a bag 12 of a holder 10 on the underside of the seat portion of the chair 11 so that items may be placed in the bag 12. After the event is over or a user otherwise wants the holder 10 remove from the chair 11, the holder 10 may be easily slipped of the seat.

Figure 8:
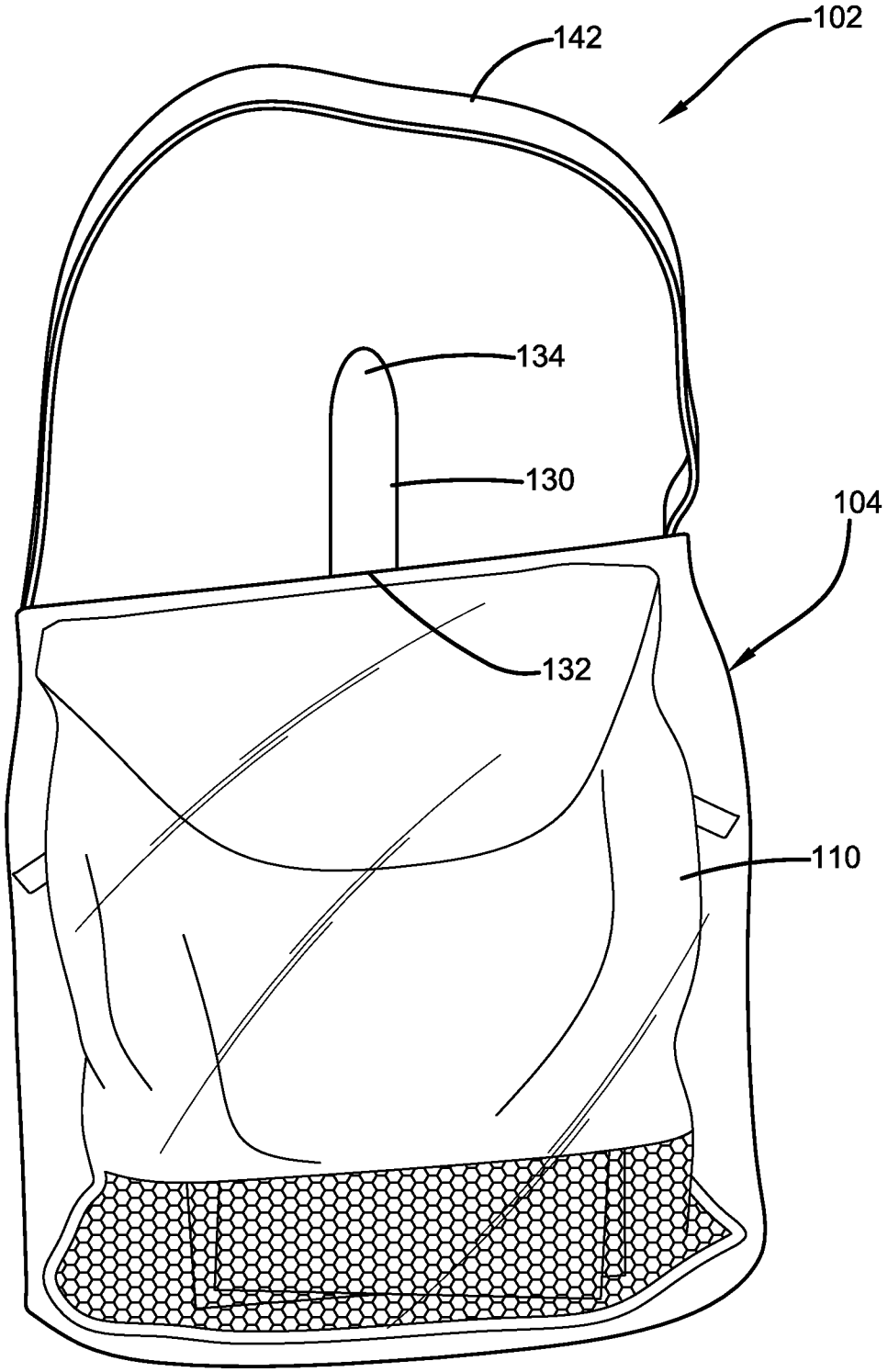
FIG. 8 is a side view of the holder of FIG. 7 as viewed in the direction facing the second panel.
Figure 9:
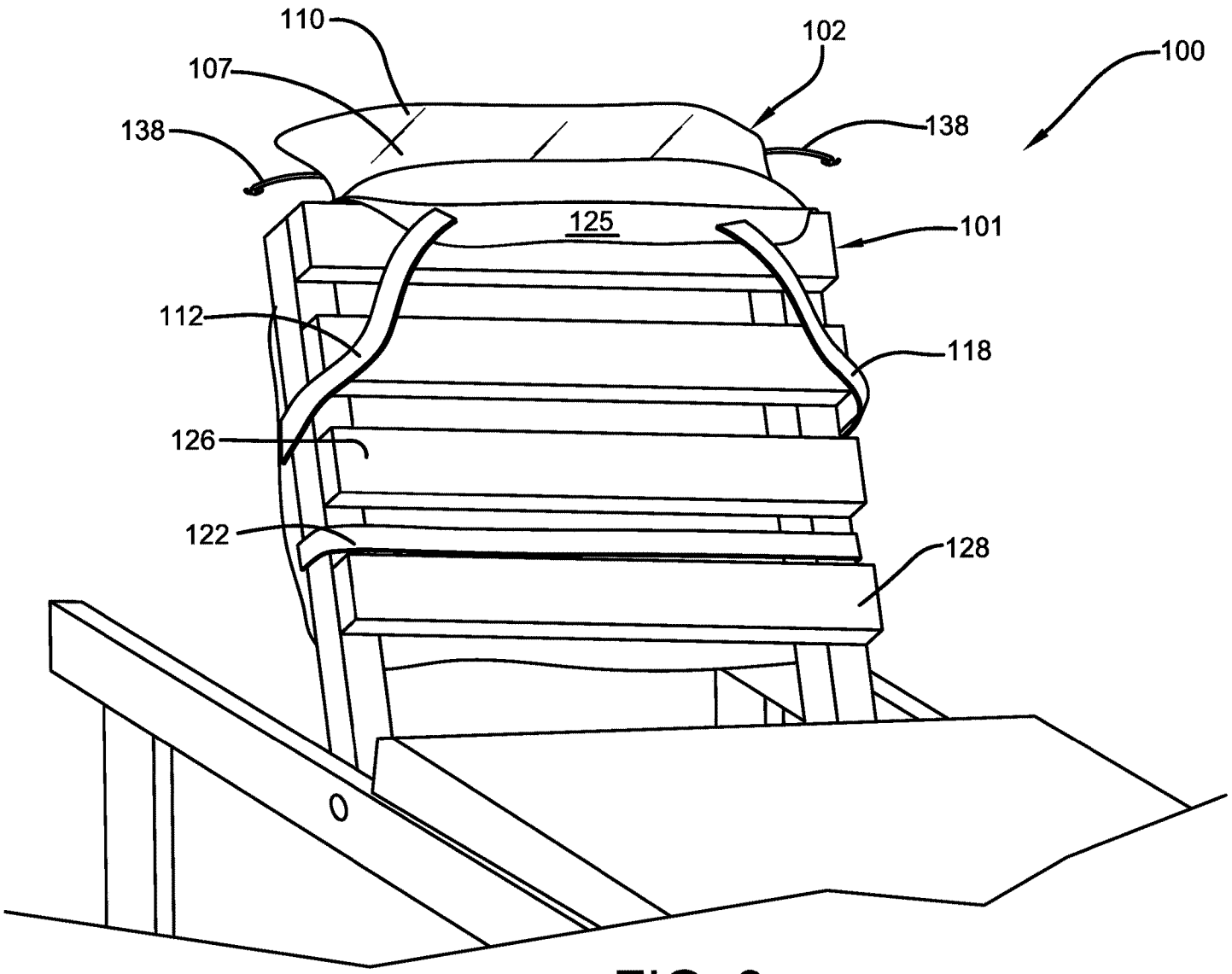
FIG. 9 is a front perspective view of the holder of FIG. 6 secured to a chair.

FIGS. 7-9 show another embodiment of an apparatus 100 of the present invention. The apparatus 100 comprises a holder 102 and a chair 101 as seen in FIG. 9. Referring to FIGS. 7 and 8, the holder 102 for a chair 101 comprises a bag 104. The bag 104 may be made of a flexible fabric material such as nylon. Other suitable materials that the bag may be made of include, for example, plastic, paper and cotton. The bag material may be made of an elastic material to enable the bag 104 to stretch and expand its volume to allow for large items 106 to be placed in the bag 104. The bag material may be waterproof. The bag 104 has a bag opening 107 (FIG. 9) for receiving items 106. The bag 104 may have a first panel 108 and a second panel 110 located opposite the first panel 108. The second panel may be clear or translucent as seen in FIG. 8 for viewing the items in the bag 104. The holder 102 includes a first strap 112 located on the first panel 108. The first strap 112 extends diagonally across a corner of the first panel 108 at the bag opening 107 of the bag 104. That is the first strap 112 extends from a first longitudinal end 114 of the first panel 108 to the axial end 116 of the first panel 108 adjacent the bag opening 107. The holder includes a second strap 118 located on the first panel 108. The second strap 118 extends diagonally across the other corner of the first panel 108 at the bag opening 107 of the bag 104. That is, the second strap 118 extends from a second longitudinal end 120 of the first panel 108 opposite the first longitudinal end 114 to the axial end 116 of the first panel 108 adjacent the bag opening 107.

The first and second straps 112, 118 slope away from each other as they extend from the bag opening 107 to the longitudinal ends 114, 120 to define an inverted V-shape as seen in FIG. 7. The holder includes a third strap 122 located on the first panel 108. The third strap 122 extends across the first panel 108 and is located near the end opposite the bag opening 107 (bottom of the bag as viewed in FIG. 7). The axial ends 124 of the straps 112, 118, 122 are stitched, sewn or otherwise attached to the bag 104 so that each of the first, second and third straps 112, 118, 122 and bag 104 define an opening or loop spanning between the axial ends 124 of the straps for securely receiving the back portion 126 or other portion of the chair. The axial ends 124 of the first and second straps 112, 118 at the bag opening are attached to the inner side 125 of the first panel 108. The straps 112, 118, 122 may be made of a flexible, strong, durable and elastic material. The straps may also be configured to have more elasticity in order to stretch more and enable the bag to expand its volume to allow for large items.

As depicted in FIG. 9, the straps 112, 118, 122 are configured to receive the back portion 126 of a chair 101 such as a lounge or beach chair to secure the holder 102 to the chair 101. In particular, the back portion 126 of the chair 101 extends through the loop defined by the third strap 122 and the first panel 108. The upper corners of the back portion 126 of the chair 101 extend through the loops defined by their respective first and second straps 112, 118 such that the bag 104 is positioned adjacent the rear side of the back portion 126 (side opposite the side that the user's back engages) with the bag opening 107 facing upward, and the straps 112, 118, 122 are located on the front side 128 of the back portion 126 (the side that the user's back engages). In this position, the upper end of the back portion 126 supports the bag 104. Thus, the bag 104 may be removably secured to the chair. To secure the bag 104 to chair 101, the elastic straps 112, 118, 122 stretched or expanded outwardly if necessary such that the openings or loops are of a sufficient size to receive the upper corners of the back portion 126. The straps 112, 118, 122 may contract to tightly secure the bag 104 to the chair 101. The bag 104 may be secured to the back portion 126 in the stowed position, operative position or any position of the back portion 126 therebetween.

The straps 112, 118, 122 may also be configured to adjust their lengths. For example, the straps 112, 118, 122 may be routed through a cam buckle type arrangement to adjust their length. The straps 112, 118, 122 may alternatively be removably attached to the bag 104 through any suitable way such as a hook and pile fastener.

As shown in FIG. 8, the bag 104 may include a looping strap 130 that can extend over and across the bag opening 107 in an operative position to at least partially close the bag opening 107. The looping strap 130 has a first axial end 132 that may be attached to the second panel 110 and a second axial end 134 that may be removably attached to the first panel 108 at a location such that the looping strap 130 closes the bag opening 107. In one embodiment, the second axial end 134 may be removably attached to the first panel 108 of the bag 104 by a hook and pile fastener such as Velcro®. In another embodiment, the second axial end 134 may be removably attached to the first panel 108 of the bag by a button. Specifically, the button may be sewn on the first panel 108 and inserted through a slit formed in the looping strap 130 or vice versa. In another embodiment, the second axial end 134 may be removably attached to the first panel 108 of the bag 104 by a snap arrangement. Alternatively, there may be other ways to close the bag opening 107. For example, the bag opening 107 may be open and closed by a zipper that extends across the bag opening 107. In another exemplary embodiment as seen in FIG. 9, the closing arrangement may include drawstrings 138. Alternatively, the bag may be closed by two straps in which a first axial end of a first strap is attached to the first panel of the bag and a first axial end of a second strap is attached to the second panel of the bag. The two sides are then tied together. Alternatively, the looping strap 130 may close the opening 107 by inserting the looping strap 130 between the outer side of the second panel 110 of the bag 104 and the rear side of the chair 101. The looping strap 130 may be looped around one of the straps 112, 118, 122 and removably fastened on itself in a stowed or storage position for storage if not in use.

As shown in FIG. 7, the bag may include a mesh panel 140 for viewing contents in the bag 104. The mesh panel 140 may be located at the bottom (as viewed in FIG. 7) of the bag 104 and adjacent the closed end of the bag 104 opposite the bag opening 107. The holder 102 may include a shoulder strap 142 that is attached to the bag 104 at or near the edge of the bag opening 107. A first axial end 144 of the shoulder strap 142 may be attached at approximately the junction of the second panel 110 and the first longitudinal end 114 of the first panel 108, and a second axial end 146 of the shoulder strap 142 may be attached at approximately the junction of the second panel 110 and the second longitudinal end 120 of the first panel 108. In operation, a user's arms extends through loop defined by the shoulder strap 142 and bag 104 and the shoulder strap 142 rests upon the shoulder of the user.

Figure 10:
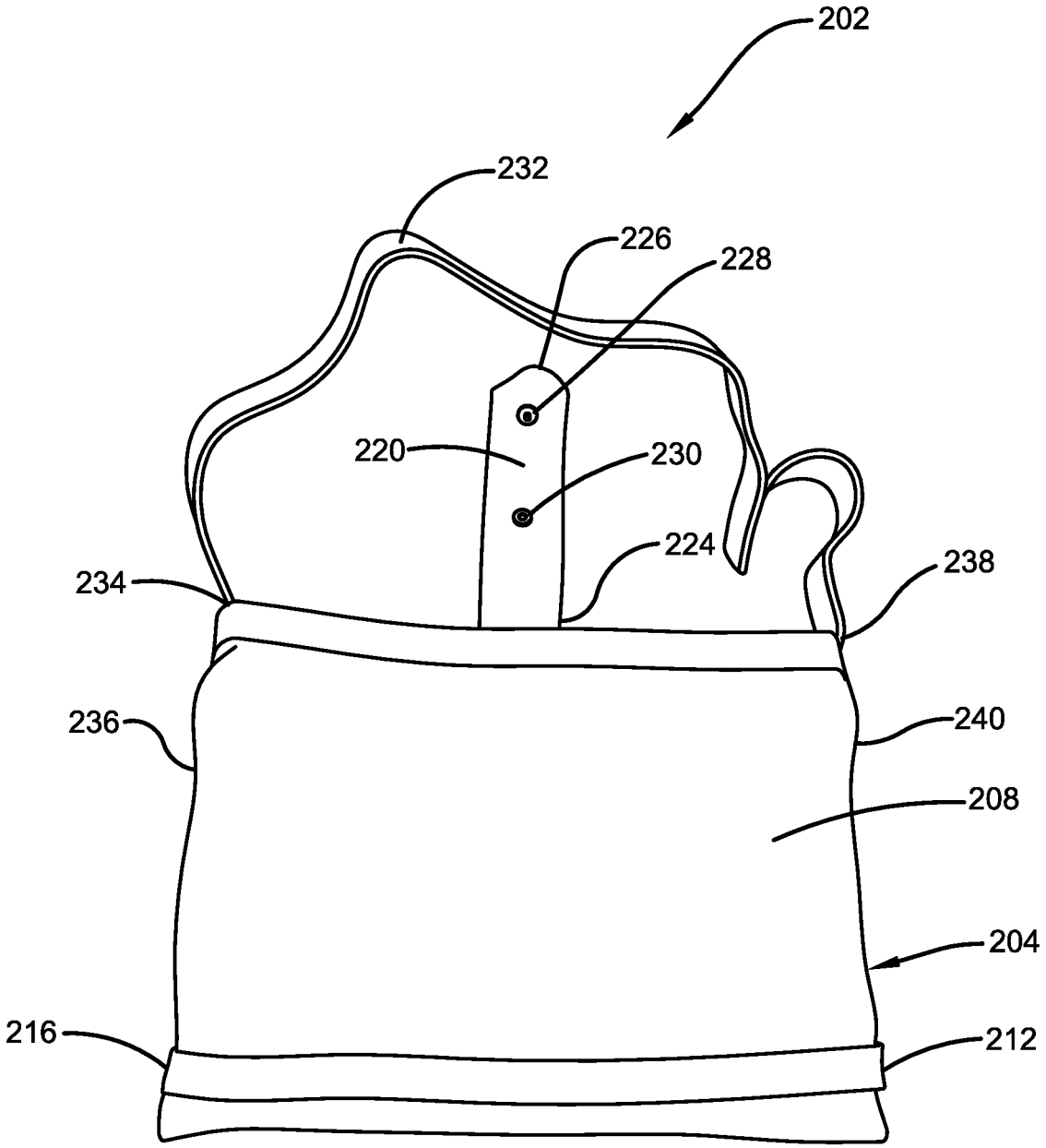
FIG. 10 is a side view of a holder of a chair as viewed in the direction facing the first panel according to another embodiment of the present invention.
Figure 11:
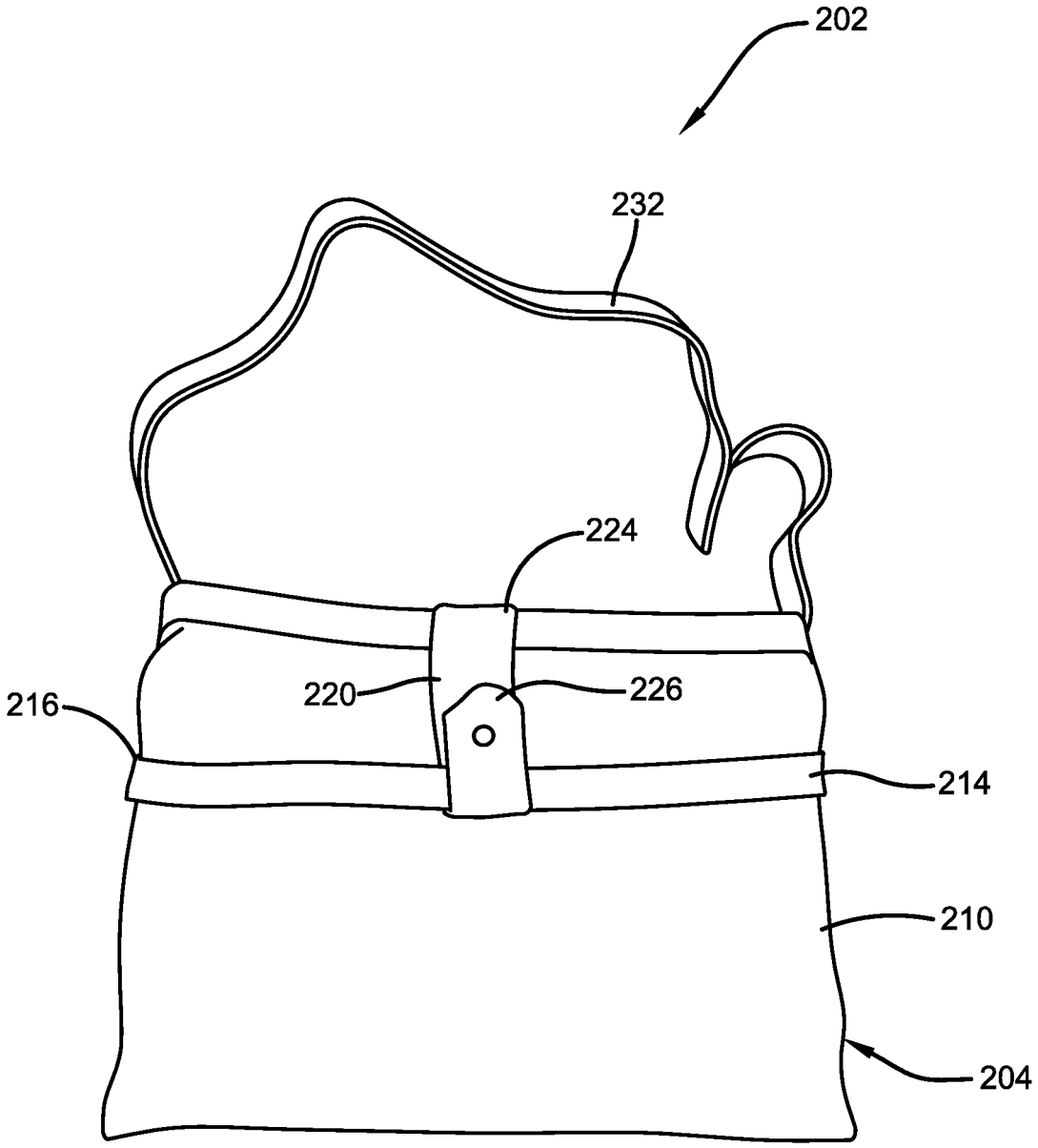
FIG. 11 is a side view of the holder of FIG. 10 as viewed in the direction facing the second panel.
Figure 12:
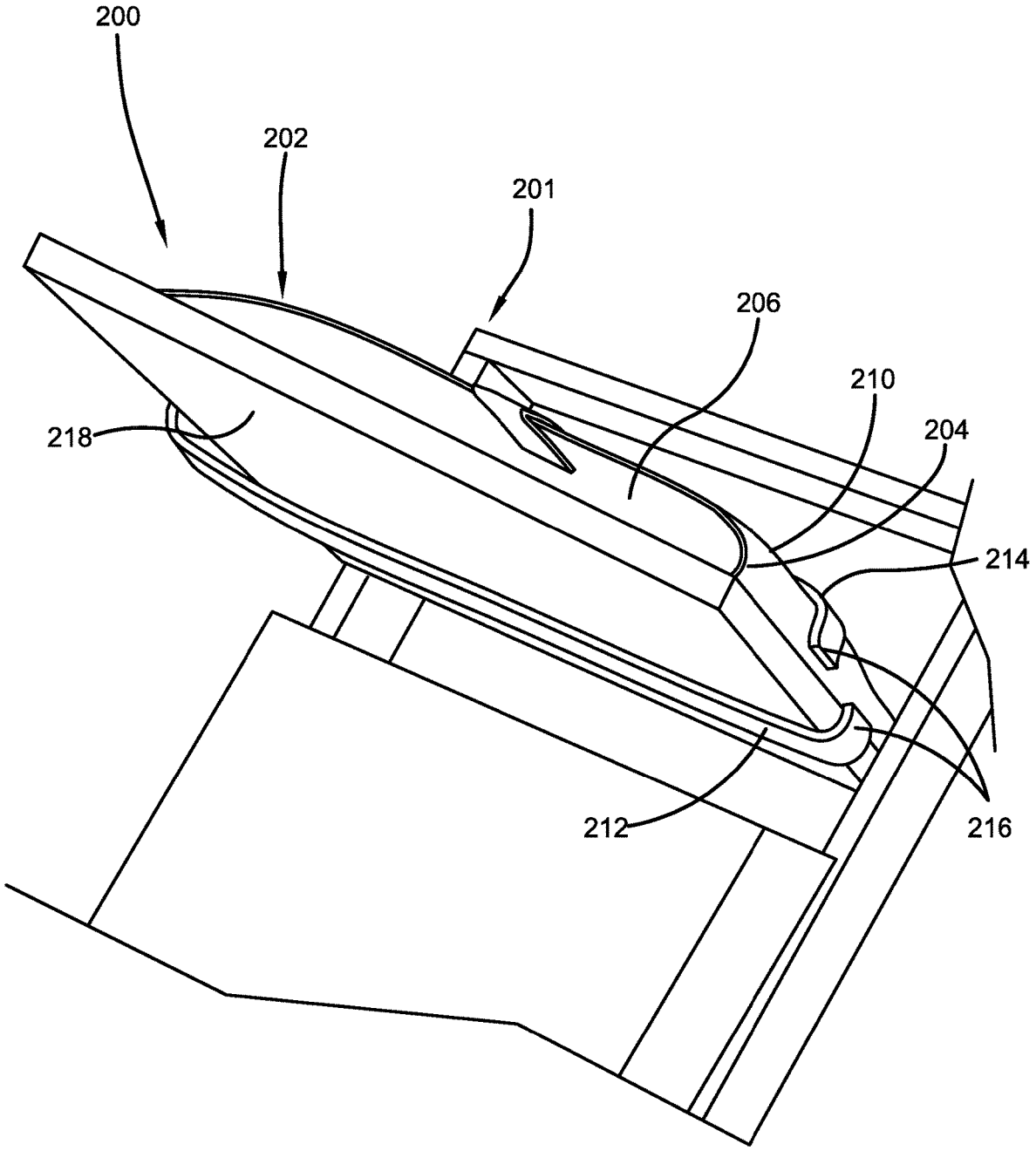
FIG. 12 is a top perspective view of the holder of FIG. 10 secured to a chair.

FIGS. 10-13 show another embodiment of an apparatus 200 of the present invention. The apparatus 200 comprises a holder 202 and a chair 201 as seen in FIG. 12. Referring to FIGS. 10-13, the holder 202 for a chair 201 comprises a bag 204. The bag 204 may be made of a flexible fabric material such as nylon. Other suitable materials that the bag 204 may be made of include, for example, plastic, paper and cotton. The bag material may be made of an elastic material to enable the bag 204 to stretch and expand its volume to allow for large items to be placed in the bag 204. The bag material may be waterproof. The bag 204 has a bag opening 206 (FIG. 12) for receiving items. The bag 204 may have a first panel 208 (FIG. 10) and a second panel 210 (FIG. 11) located opposite the first panel 208. The first and second panels 208, 210 may be clear or translucent for viewing the items in the bag 204 or opaque to cover the items from view. The holder 202 includes a first strap 212 located on the first panel 208. The first strap 212 extends across the first panel 208 and is located near the end opposite the bag opening 206 (bottom of the bag as viewed in FIG. 10). The holder 202 includes a second strap 214 located on the second panel 210. The second strap 214 extends across the second panel 210 and is located near the edge of the bag opening 206 (top of the bag as viewed in FIG. 10). The placement of the first and second straps 212, 214 allows either of the panels 208, 210 of the bag 204 to face the back portion 218 or other portion of the chair 201 that the bag 204 is secured to.

The axial ends 216 of the each strap are stitched, sewn or otherwise attached to the bag so that each of the first and second straps 212, 214 and bag define an opening or loop spanning between the axial ends 216 of the straps 212, 214 for receiving the back portion 218 of the chair 201. The first and second straps 212, 214 may be made of a flexible, strong, durable and elastic material. The straps, 212, 214 may also be configured to have more elasticity in order to stretch more and enable the bag 204 to expand its volume to allow for large items.

The straps 212, 214 are configured to receive a seat, back or other portion of a chair 201 to secure the bag 214 to the chair 201. For example, a back portion 218 of the chair may extend through the loop defined by the first strap 212 and the first panel 208 such that the first panel 208 of the bag 204 is positioned adjacent the rear side of the back portion 218 (side opposite the side that the user's back engages) with the bag opening 206 facing upward, and the first strap 212 is located on the front side of the back portion 218 (the side that the user's back engages). Alternatively, the back portion 218 of the chair may extend through the loop defined by the second strap 214 and the second panel 210 such that the second panel 210 of the bag 204 is positioned adjacent the rear side of the back portion 218 (side opposite the side that the user's back engages) with the bag opening 206 facing upward, and the second strap 214 is located on the front side of the back portion 218 (the side that the user's back engages).

As illustrated in FIG. 12, the bag 204 may be removably secured to the chair 201. To secure the bag 204 to chair 201, the elastic straps 212, 214 stretch or expanded outwardly if necessary such that the openings or loops are of a sufficient size to receive the back portion 218 of the chair 201. The straps 212, 214 may contract to tightly secure the bag 204 to the chair 201. The bag 204 may be secured to the back portion 218 in the stowed position, operative position or any position of the back portion 218 there between.

The straps 212, 214 may also be configured to adjust their lengths. For example, the straps 212, 214 may be routed through a cam buckle type arrangement to adjust their length. The straps 212, 214 may alternatively be removably attached to the bag 204 through any suitable way such as a hook and pile fastener.

As shown in FIGS. 10 and 11, the bag 204 may include a looping strap 220 that can extend over and across the bag opening 206 in an operative position to at least partially close the bag opening 206. The looping strap 220 has a first axial end 224 that may be attached to the second panel 210 and a second axial end 226 that may be removably attached to the first panel 208 at a location such that the looping strap 220 closes the bag opening 206. In one embodiment, the second axial end 226 may be removably attached to the first panel 208 of the bag 204 by a hook and pile fastener such as Velcro®. In another embodiment, the second axial end 226 may be removably attached to the first panel 208 of the bag 204 by a button. Specifically, the button may be sewn on the second side and inserted through a slit formed in the strap or vice versa. In another embodiment, the second axial end 226 may be removably attached to the first panel 208 of the bag 204 by a snap arrangement. Alternatively, there may be other ways to close the bag opening 206 of the bag 204. For example, the bag opening 206 may be open and closed by a zipper that extends across the bag opening 206. In another exemplary embodiment, the closing arrangement may include drawstrings. In still another exemplary embodiment, the closing arrangement may include two straps in which a first axial end of a first strap is attached to the first panel 208 of the bag 204 and a first axial end of a second strap is attached to the second panel 210 of the bag 204. The two sides are then tied together. Alternatively, the looping strap 220 may close the bag opening 206 by inserting the looping strap 220 between the outer side of the first panel 208 of the bag 204 and the rear side of the chair 201.

As seen in FIG. 11, the looping strap 220 may be looped around the second strap 214 and removably fastened on itself in a stowed or storage position for storage if not in use. The fastening arrangement may be any suitable type. For example, the fastening arrangement may include a snap arrangement in which a metal projection 228 (FIG. 10) attached to the looping strap 220 snaps into a socket 230 (FIG. 10) also attached to the looping strap 220. Other fastening arrangements may include a hook and pile fastener such as Velcro® or a button.

Figure 13:
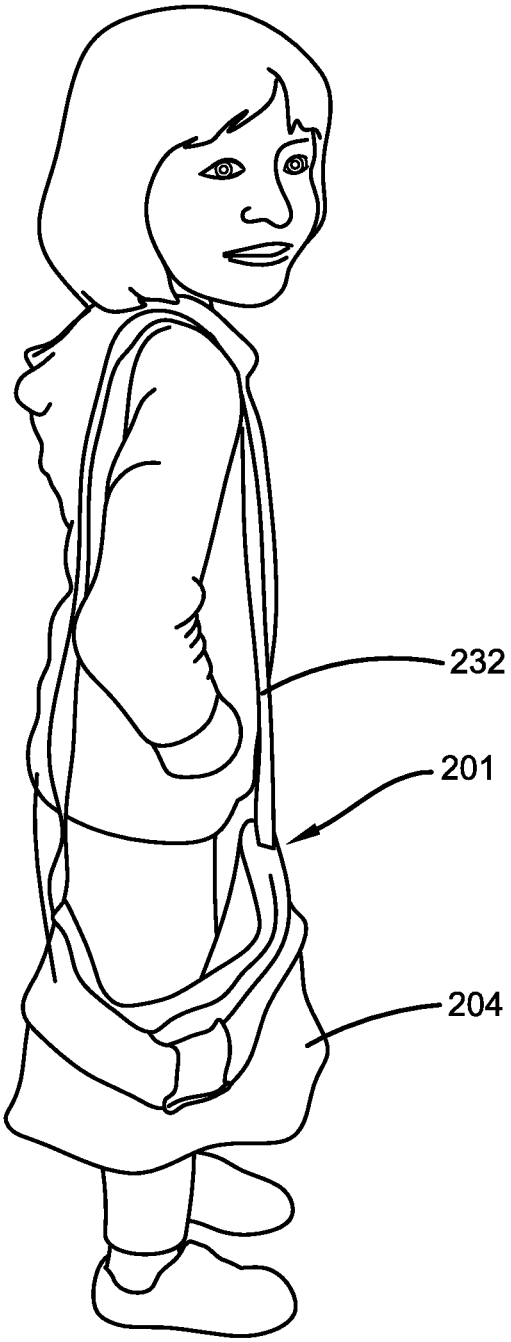
FIG. 13 is a perspective view of the holder of FIG. 10 placed on the shoulder of a user.

The holder 202 may include a shoulder strap 232 that is attached to the bag 204 at or near the edge of the bag opening 206. A first axial end 234 of the shoulder strap 232 may be attached at approximately the junction of the second panel 210 and the first longitudinal end 236 of the first panel 208, and a second axial end 238 of the shoulder strap 232 may be attached at approximately the junction of the second panel 210 and the second longitudinal end 240 of the first panel 208. As seen in FIG. 13, a user's arms extends through loop defined by the shoulder strap 232 and the bag 204, and the shoulder strap 232 rests upon the should of the user.

The material of the bags may include but not limited to leather, burlap, suede, wool, polyester, rayon, etc. Logos such as team logos may be on the bag. The straps can be of any size including the ones on the bag and could also include but not limited to leather and adjustable straps.

Although various embodiments of the holder for a chair have been shown and described, modifications may occur to those skilled in the art upon reading the specification. The present application includes such modifications and is limited only by the scope of the claims. Moreover, in the following claims, the terms "first," "second," and "third," etc. are used merely as labels, and are not intended to impose numerical requirements on their objects or order of execution on their acts.

What is claimed is:

1. A holder for a chair, wherein the chair includes a seat portion and a back portion, wherein the holder comprises:

a bag, wherein the bag includes a bag opening;

at least a first strap, wherein the first strap is attached to the bag, wherein the first strap extends across the bag, wherein the first strap and the bag define a first opening that is configured to securely receive one of a seat portion and a back portion or both;

a shoulder strap, wherein the shoulder strap includes first and second axial ends attached near the bag opening, wherein the shoulder strap is configured to enable a user to carry the bag on their shoulder; and at least second and third straps, wherein the second and third straps are attached to the bag, wherein each of the second and third straps extends along the bag from substantially the edge of the bag opening at an oblique angle relative to a central axis of the bag that extends between the bag opening and a closed end of the bag opposite the bag opening, wherein the second and third straps diverge from each other extending from the edge of the bag opening to a direction along the bag, wherein the second and third straps and bag define second and third openings that are configured to securely receive the back portion.

2. The holder of claim 1, further comprising a mesh portion for viewing contents in the bag.

3. The holder of claim 1, wherein the first strap is located near the end of the bag opposite the bag opening.

4. The holder of claim 1, further comprising a closing device, wherein the closing device is operative to open and close the bag opening.

5. The holder of claim 1, further comprising opposite first and second panels, wherein at least one of the first panel and the second panel is translucent for viewing items in the bag.

6. The holder of claim 1, wherein the first strap is elastic.

7. A holder for a chair comprising a bag, wherein the bag includes opposite first and second portions that define a bag opening;

at least a first strap, wherein the first strap is attached to the first portion of the bag, wherein the first strap extends laterally across the bag, wherein the first strap and the bag define a first opening that is configured to securely receive a seat portion; and at least a second strap, wherein the second strap is attached to the first strap, wherein the second strap is not parallel to the first strap, wherein the second strap is attached to the first portion of the bag at a location near the bag opening, wherein the second strap is configured to extend over the seat portion to support the bag to the seat portion.

8. The holder for a chair of claim 7, further comprising at least a third strap, wherein the third strap is attached to the first portion of the bag, wherein the third strap extends laterally across the bag, wherein the third strap and the bag define a second opening that securely receives a seat portion.

9. The holder of claim 7, wherein the second strap is configured to extend over a front edge of the seat portion to support the bag to the seat portion.

10. The holder of claim 7, wherein the second strap is removably attached to the first portion of the bag at the location near the bag opening.

11. The holder of claim 7, wherein the first strap is elastic.

12. The holder of claim 7 wherein the second portion includes a mesh panel.

13. The apparatus of claim 7, wherein the bag may be made of a flexible fabric.

14. The apparatus of claim 7, further comprising a shoulder strap, wherein the shoulder strap includes first and second axial ends attached near the bag opening, wherein the shoulder strap is configured to enable a user to carry the bag on their shoulder.

15. An apparatus comprising:

a bag;

at least a first strap;

a chair, wherein the chair comprises a back portion and a seat portion, wherein the bag includes opposite first and second portions that define a bag opening, wherein the first strap is attached to the first portion of the bag, wherein the first strap extends laterally across the bag, wherein the first strap and the bag define a first opening that securely receives a seat portion such that the first portion is position below the seat portion and the bag opening faces away from the back portion; and at least a second strap, wherein the second strap is attached to the first strap, wherein the second strap is attached to the first portion of the bag at a location near the bag opening, wherein the second strap is extends over the seat portion to support the bag to the seat portion, wherein the second strap is not parallel to the first strap.

16. The apparatus of claim 15, wherein the second strap is removably attached to the first portion of the bag at the location near the bag opening.

17. The apparatus of claim 15, further comprising at least a third strap, wherein the third strap is attached to the first portion of the bag, wherein the third strap extends laterally across the bag.

18. The apparatus of claim 15 wherein the first strap is elastic, wherein the first strap is configured to expand to enable the seat portion to extend through the first opening and then contract to tightly secure the bag to the seat portion.

19. The apparatus of claim 15, wherein the second strap is extends over a front edge of the seat portion to support the bag to the seat portion.

20. The apparatus of claim 15, further comprising a shoulder strap, wherein the shoulder strap includes first and second axial ends attached near the bag opening, wherein the shoulder strap is configured to enable a user to carry the bag on their shoulder.

* * * * *